United States Patent [19]

Yamada

[11] Patent Number: 4,538,845

[45] Date of Patent: Sep. 3, 1985

[54] AUTOMOBILE LOCKING APPARATUS

[75] Inventor: Shinjiro Yamada, Tokyo, Japan

[73] Assignee: Mitsui Kinzoku Kogyo K. K., Tokyo, Japan

[21] Appl. No.: 498,395

[22] Filed: May 26, 1983

[30] Foreign Application Priority Data

May 31, 1982 [JP] Japan ..... 57-92696
Sep. 16, 1982 [JP] Japan ..... 57-161411

[51] Int. Cl.[3] ..... E05C 3/26

[52] U.S. Cl. ..... 292/216; 292/337; 292/DIG. 38

[58] Field of Search ..... 292/216, 280, 337, 1, 292/DIG. 38

[56] References Cited

U.S. PATENT DOCUMENTS 3,843,175 10/1974 Klebba ..... 292/216
3,844,593 10/1974 Slattery ..... 292/216 X
4,358,141 11/1982 Hamada ..... 292/216

*Primary Examiner*—Richard E. Moore
*Attorney, Agent, or Firm*—Shlesinger, Fitzsimmons & Shlesinger

[57] ABSTRACT

This automobile locking apparatus includes a one-piece, molded, plastic body having a pivotal door latch and associated ratchet pivotally mounted in a recess in one side thereof and a cooperating release lever and locking lever pivotally mounted, respectively, on a pair of integral sleeves which project from the opposite side of said body coaxially of the pivot axes of said latch and ratchet. A link which interconnects the release and locking levers, respectively, is engageable with a pin on the ratchet to prevent the locking lever to be swung into a locking position except which the release lever has been swung to a door-opening position.

4 Claims, 29 Drawing Figures

AUTOMOBILE LOCKING APPARATUS

BACKGROUND OF THE INVENTION

This invention relates to an automobile locking apparatus.

The prior art automobile locking apparatus has the problem that its component parts make unpleasant noises every time vibrations of the vehicle occur. In order to overcome said problem, the present invention uses the simple means of a base body made of synthetic resins, and including shafts or tubes extending from said base body to which said component parts are fitted.

In many key-less door locking apparatus of the prior art, a ratchet which is engaged with a latch, is used not under compressive stress but under tensile stress to prevent a reversal of rotation of a latch.

Namely, to prevent a reversal of rotation of a latch, a pawl equipped with a ratchet is engaged with a notch of the latch, thus preventing reversal of rotation of a latch. Structures such as above, however, have the disadvantage of tensile stress.

But by the novel structure mentioned hereinafter, a ratchet can be used under compressive stress.

It is the primary object of this invention to provide an automobile locking apparatus which component parts, for example, latch, ratchet and release lever, can easily be fitted therein without said parts loosening.

It is another object of this invention to provide an automobile locking apparatus being entirely simple in construction.

It is a further object of this invention to provide an automobile locking apparatus being small in size, light, solid, compact and economical on account of its component parts being small, adding that which causes surer power transmission.

An embodiment in accordance with the present invention a ratchet is used under tensile stress will now be described with reference to the accompanying drawings in which.

DETAILED DESCRIPTION OF THE PREFERRED EMBODIMENT OF THIS INVENTION

Figure 1:
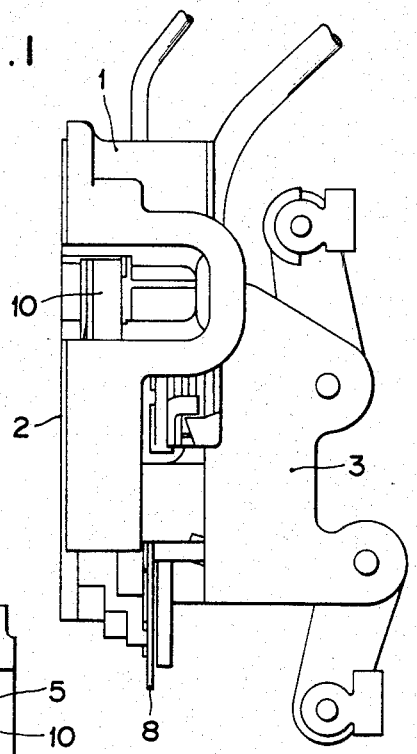
FIG. 1 is a side elevational view of an automobile locking apparatus made according to one of the embodiments of this invention.
Figure 2:
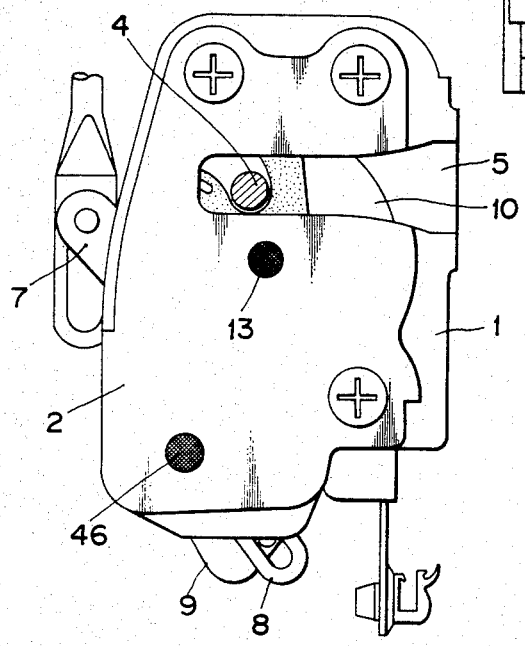
FIG. 2 is a front view of said apparatus.
Figure 3:
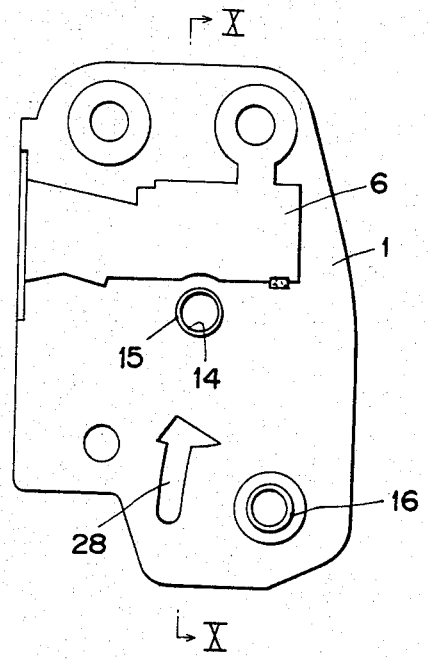
FIG. 3 is a back view of a base body which forms part of said apparatus.
Figure 4:
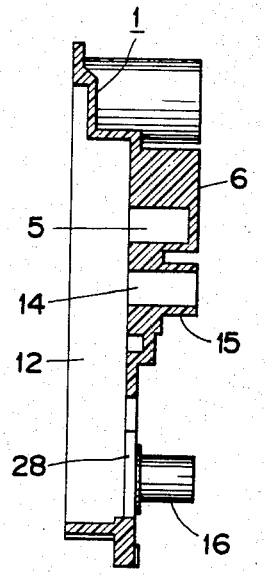
FIG. 4 is a sectional view taken along the line IV—IV in FIG. 3, looking in the direction of the arrows.
Figure 5:
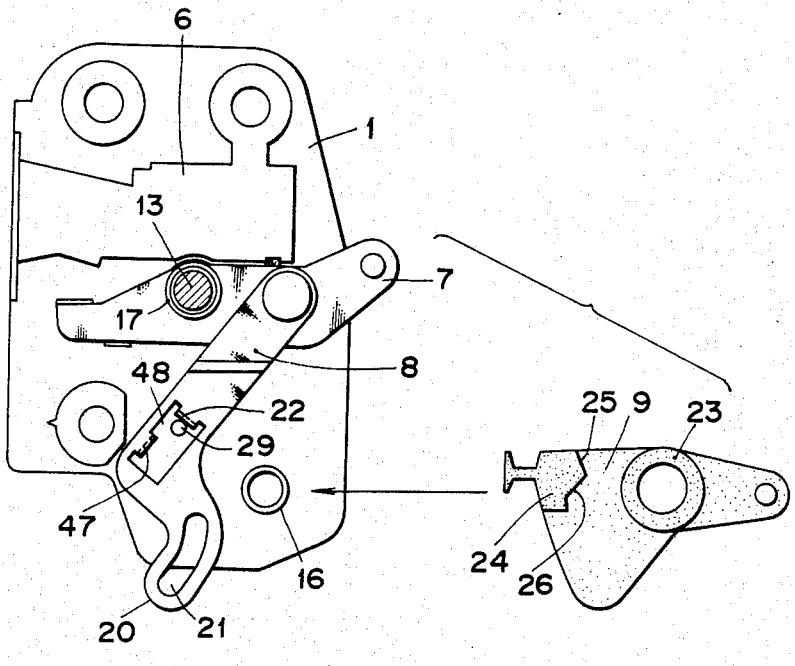
FIG. 5 is an exploded view similar to FIG. 3 but showing how a locking lever can be fitted on a base body on which a release lever and a link are already fitted.
Figure 6:
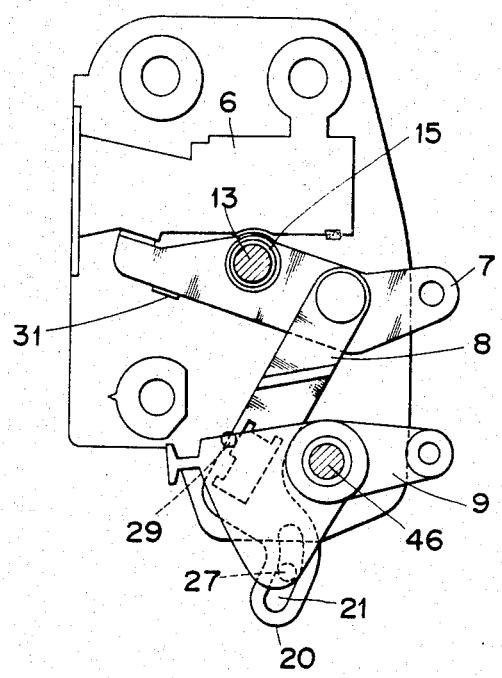
FIG. 6 is a back view of a base body on which a release lever, a link and a locking lever are already fitted.
Figure 7:
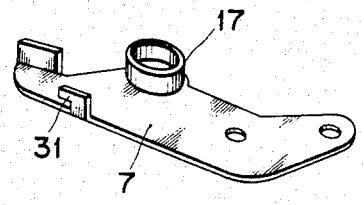
FIG. 7 is a perspective view of said release lever.
Figure 9:
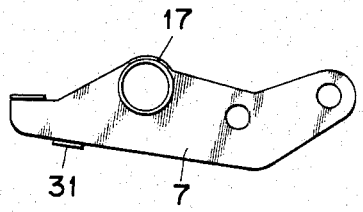
FIG. 9 is a back view of said release lever.
Figure 8:
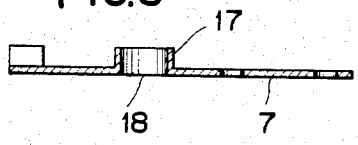
FIG. 8 is a vertical sectional view of said release lever.
Figure 16:
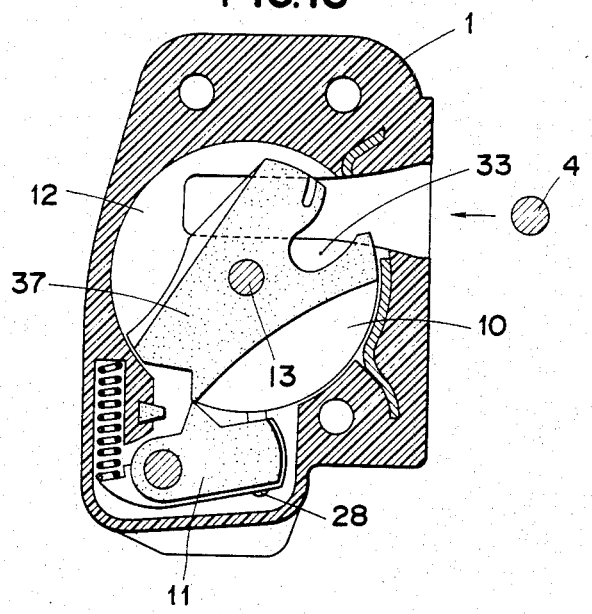
FIG. 16 is an assembly view of said base body, latch, spring and ratchet.

As illustrated in its entirety in FIGS. 1 and 2, the numeral 1 denotes the base body made of synthetic resins according to this invention. Said body 1 is shown vertically as it appears when mounted within a door, and has metallic cover plate 2 and back plate 3, respectively, mounted at front and back sides thereon. Admission part 5 for striker 4 is formed in a slight upper portion from a longitudinal center of said body 1. To form said admission part, a raised portion 6 is provided on a back side of body 1, in FIG. 3. Release lever 7 and locking lever 9 are well arranged in the back side of said body below the admission part, in FIG. 5. On a front side of said body, the base body has a recess 12 which receives latch 10 and ratchet 11 for preventing the reversal of rotation of said latch. As shown in FIG. 16, relation of said latch and ratchet is almost one above the other. The numeral 13 denotes the shaft which is used in order to pivotally mount latch 10 through body 1, and which is inserted into an axial hole 14 formed in body 1. The synthetic resinous base body has sleeve 15 made by injection molding on a back side of hole 14. Accordingly, when shaft 13 is inserted into sleeve 15 and supported by the sleeve, said latch can be fitted within recess 12 without their loosening. In the same way, ratchet 11 can be fitted within recess 12 witout their loosening, because said ratchet is supported by a shaft 46 inserted into synthetic resinous sleeve 16 extending from base body outwardly. FIG. 5 shows how the locking lever 9 can be fitted with base body 1 with which release lever 7 and link 8 are already fitted. As shown in FIGS. 7, 8 and 9, sleeve 17 is made by press forging in an almost horizontal center of the release lever. Namely, release lever 7 and link 8 are made by punching a metallic plate, such as iron plate or brass plate.

Figure 10:
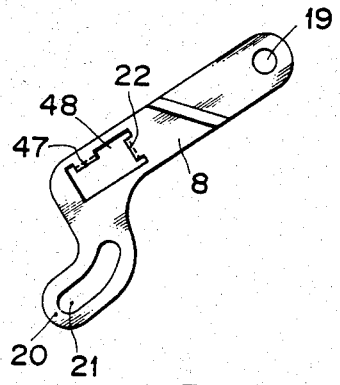
FIG. 10 is a back view of said link.
Figure 11:
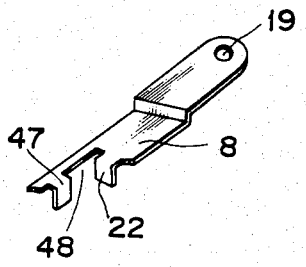
FIG. 11 is a perspective view of said link, a portion of the element being cut away.
Figure 27:
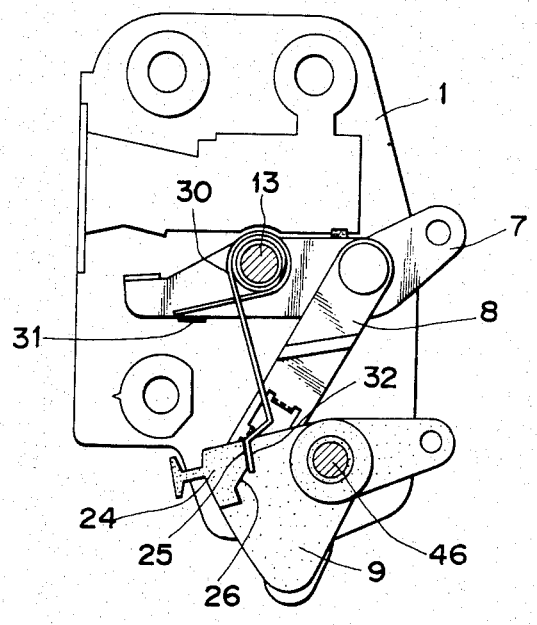
FIG. 27 is an explanatory view showing said locking lever in a locked position.

However, when release lever 7 is punched, the axial hole 18 and surrounding metallic sleeve 17 of release lever 7 are made by deep-drawing. Accordingly, when release lever 7 is mounted to base body 1, deep-drawn sleeve 17 of said lever fits well with synthetic resinous sleeve 15 of body 1, so that said lever is well seated within said body without loosening. As best shown in FIG. 27, torsion coil spring 30 always applies a downward force to the end b, and an upward force to the end a of release lever 7, and a portion of end a is stopped against a cushion mounted in raised portion 6. Said end a is connected with a rod coupled to a door knob (not shown in FIGS.). Link 8 is also made by press forging and as shown in FIGS. 10 and 11 includes an axial hole 19 in its upper end portion, an arched guide slot 21 in its other end portion, an opening 48 in the middle of it, and abutting bits 22 and 47 bent at a right angle to it at said opening. Opening 48, which the projection 29 on ratchet 11 can be slidably moved through, is formed between bits 22 and 47.

Figure 12:
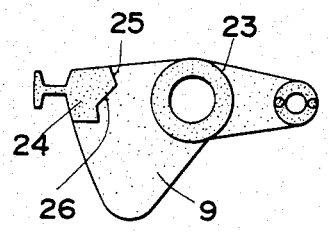
FIG. 12 is a back view of said locking lever.
Figure 13:
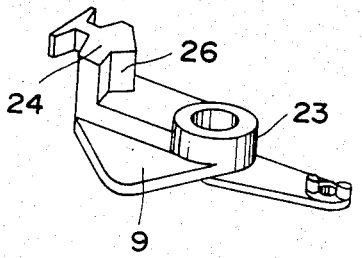
FIG. 13 is a perspective view of said locking lever.
Figure 14:
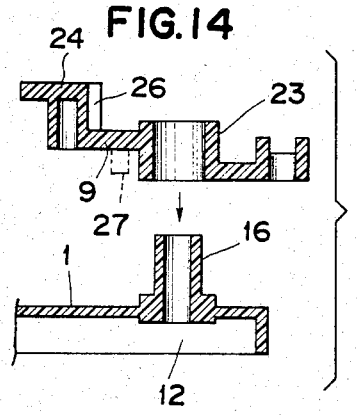
FIG. 14 is an exploded sectional view of said locking lever and part of said base body.
Figure 15:
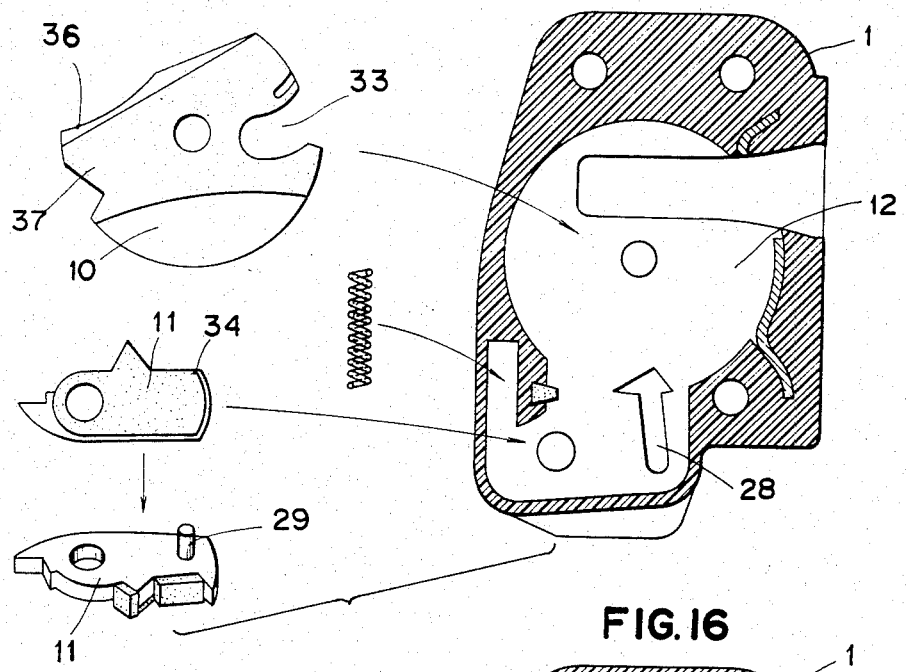
FIG. 15 is an exploded view of said base body, and a latch, spring and ratchet.
Figure 23:
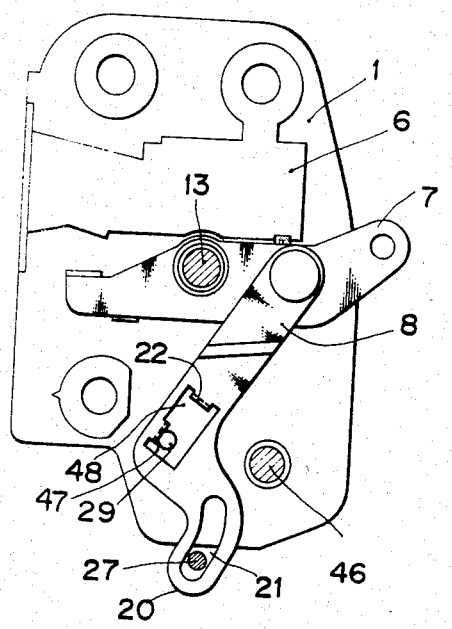
FIG. 23 is a back view showing said release lever and link in an unlocked position.
Figure 26:
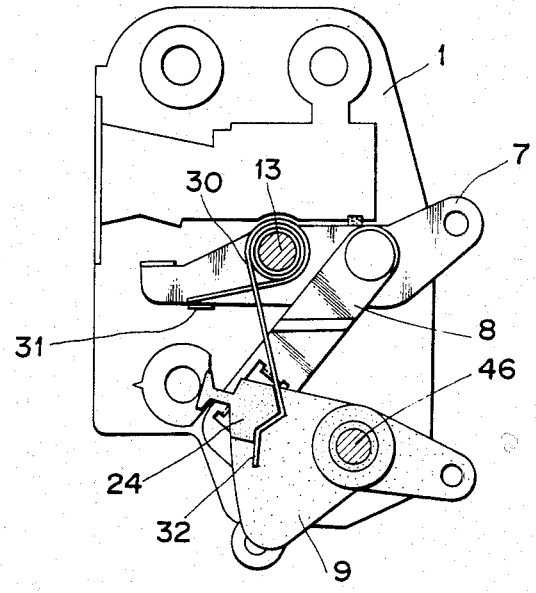
FIG. 26 is an explanatory view showing said locking lever in an unlocked position.
Figure 28:
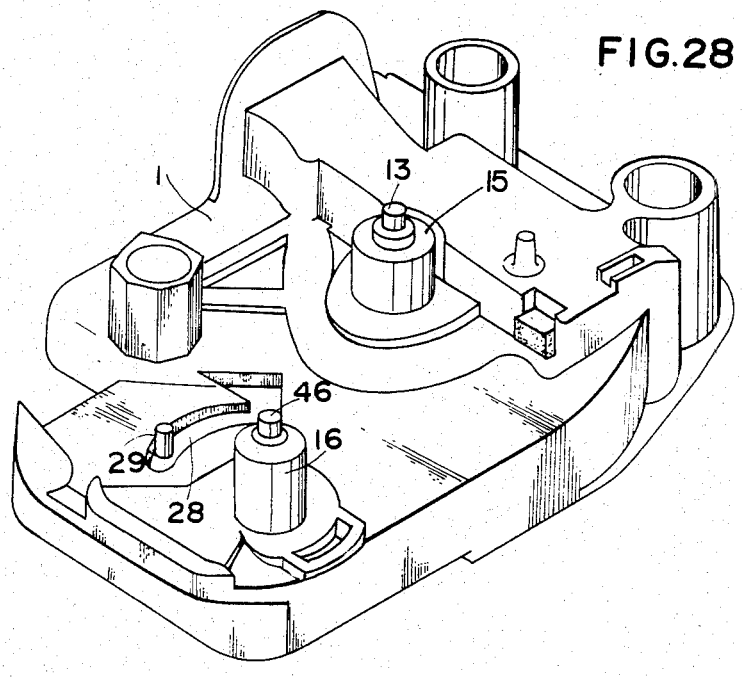
FIG. 28 is a perspective view of said base body.
Figure 29:
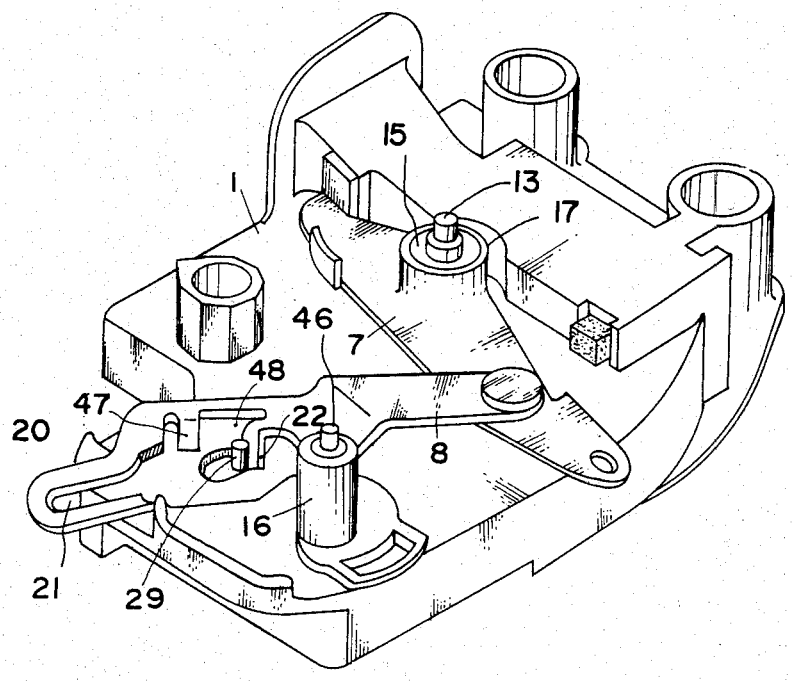
FIG. 29 is an explanatory view showing said base body, release lever and link being fitted therein.

As shown in FIGS. 12, 13 and 14, the locking lever 9 made of a synthetic resinous material includes, in its middle, a sleeve 23 similar to sleeve 17 formed on release lever 7, said sleeve 23 being well fitted with the outside of sleeve 16 extending from the body 1. However, said locking lever is made of synthetic resins, so that sleeve 23 is formed not by deep-drawing, but by injection molding. A mountain-shaped abutment member 24 is formed in the left side of lever 9, with the top of member 24 facing toward sleeve 23. The numerals 25 and 26 denote abutment sides formed in both sides of the top of said member 24 respectively. The locking lever 9 is equipped with an injection molded projection 27 engaged within the arched guide slot 21 formed in the link 8 (FIG. 23). When the locking lever is fitted with the body, end 20 formed in the link is sandwiched between the lever 9 and the body. The body has a connective opening 28 therethrough, in FIG. 28, and projection 29 extends from ratchet 11 through said opening 28 to the opposite side. Locking lever 9 as shown in FIGS. 26 and 27, moves between its unlocked position and locked position. In FIG. 23, it shows the positions of the link 8 and release lever 7 when locking lever 9 is in its unlocked position, and the door is opened. When said situation exists the locking lever cannot be turned around from unlocked to locked position. Namely, abutting bit 47 on the link 8 is engaged with projection 29, so that the link 8 cannot be turned counter-clockwise, and the locking lever 9 cannot be moved into locked position. Though the locking lever can be moved into its locked position by doing the next thing. That is, by moving the end a of release lever 7 downwardly and placing projection 29 in the interspace 48, in FIG. 23, end 20 of link 8 can be moved rightwardly and locking lever 9 can be turned and moved into its locked position.

Figure 18:
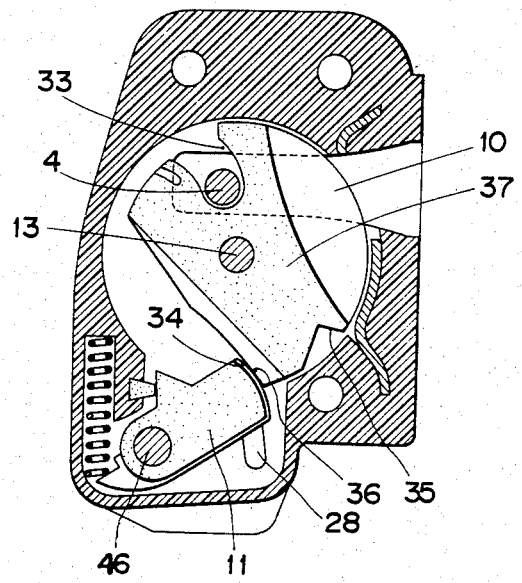
FIG. 18 is an explanatory view showing said latch and ratchet in a fully locked position with respect to a striker.
Figure 19:
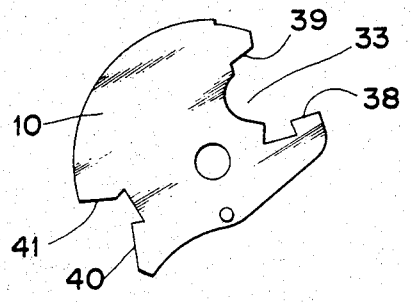
FIG. 19 is a front view of a metallic portion of said latch.
Figure 20:
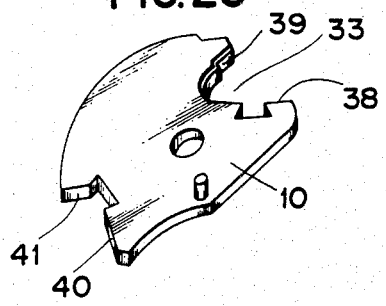
FIG. 20 is a perspective view of said metallic portion.
Figure 21:
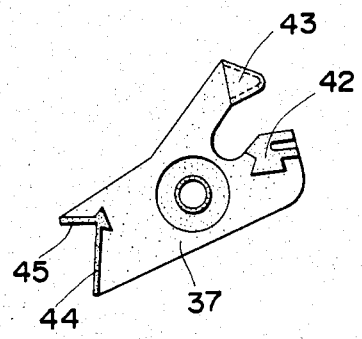
FIG. 21 is a front view of a resilient covering of said latch.
Figure 22:
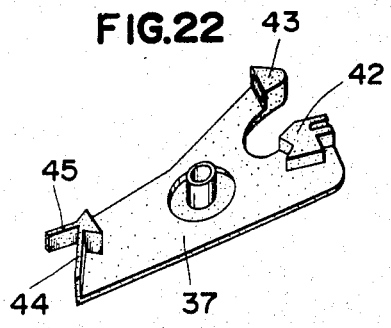
FIG. 22 is a perspective view of said resilient covering.

Referring to FIGS. 26 and 27, torsion coil spring 30 for holding the locking lever is illustrated. One end of said spring is connected with an abutting bit 31, the other end 32 being shaped as a wedge is engaged with the mountain-shaped abutment member 24 on lever 9. Latch 10, which is seated within recess 12 on body 1, includes a groove 33 engagable with striker 4, and a semi-locked portion or notch 35, and a full locked portion or surface 36 engaged with supporting member 34 of ratchet 11 in FIG. 18. Numeral 37 denotes a covering of resilient material made of rubber or so forth, which covers at least the abutment sides 38 and 39 of the groove 33 of latch 10 which are engagable by striker 4 and also covers the abutment sides 40 and 41 of the notch or semi-locked portion 35. In the drawings numeral 43 denotes a portion of the covering 37 corresponding to abutment side 39 of latch 10, numeral 44 denotes a portion of the covering corresponding to abutment side 40 of latch 10, and numeral 45 denotes a portion of the covering corresponding to abutment side 41 of latch 10.

Figure 17:
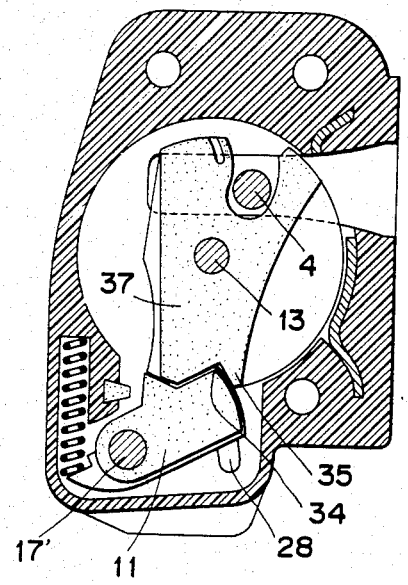
FIG. 17 is an explanatory view showing said latch and ratchet in a semi-locked position with respect to a striker.
Figure 24:
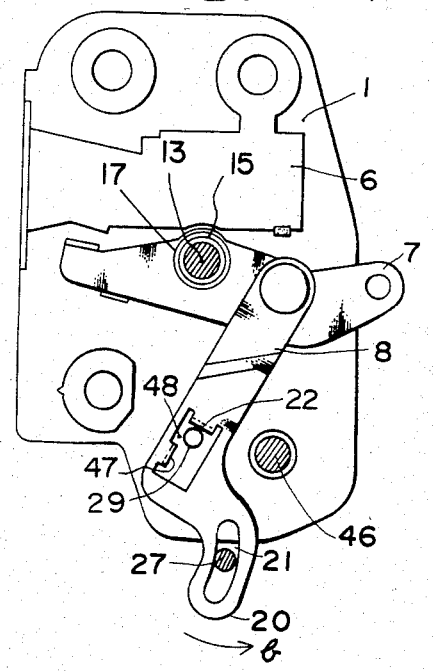
FIG. 24 is an explanatory view showing said release lever and link operated to open a door.
Figure 25:
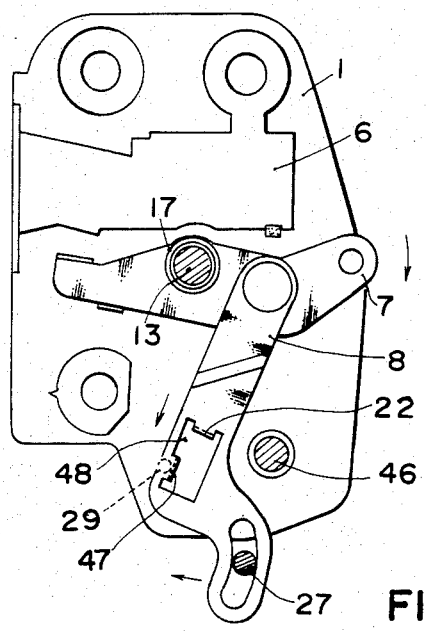
FIG. 25 is an explanatory view showing a sill-knob pushed after operating a door to open.

This locking apparatus operates as follows:

In the situation where the associated door is opened, projection 29 of ratchet 11 is positioned as shown in FIG. 23, and bit 47 of link 8 is engaged by projection 29 via said spring 30. In accordance with said engagement, the end 20 of link 8 cannot be moved rightwardly in FIG. 23, so that locking lever 9, which is engaged with link 8 by projection 27, also cannot be moved into its locking position as shown in FIG. 27. By means of this function, it is possible to prevent the mislaying of the key inside of a car by unconsiously pushing the sill-knob connected with the right end of locking lever 9 (key-less locking apparatus). When operation of the handle of the door that is connected with the end a of release lever 7 is complete, in short, pushing the end a of release lever downwardly, the engagement between bit 47 and projection 29 is separated as shown in FIG. 24, and the projection can be moved through the interspace 48. Accordingly, the locking lever now can be easily moved into its locking position by pushing the sill-knob. When with the locking lever 9 in its locking position, the door is closed, striker 4 is engaged with groove 33 of the latch, in FIGS. 16 to 18, and supporting member 34 of the ratchet is engaged with the full locked portion 36, and this engagement of member 34 prevents the reversal of rotation of the latch. In this case, the structure of this apparatus is very strong, because ratchet 11 is used under the compressive stress (force of compressing the ratchet). Locking lever 9, which is positioned in its locking position of FIG. 27, is held in its position by the wedge-shaped end of spring 32 holding the abutment side 25 of locking lever. Though link 8 is moved downwardly resulting in release lever being rotated clockwise, latch 10 cannot be free from ratchet 11 for the sake of abutting bit 22 being shifted out of registry with projection 29. Finally, the lock is accomplished.

Considering the shafts used for pivotally mounting the latch and ratchet of prior art automobile locking apparatus, such shafts usually are fixed to a metallic cover plate at both sides of base body and extend through the body. There is nothing but the shaft passing through the body.

In this invention, however, there are the integral sleeves 15 and 16 which are made by a one-piece molding on the back side of body 1, and said sleeves pivotally support the shafts 13 and 46 that are used for pivotally mounting the latch and ratchet, respectively. Owing to this structure, component parts are well fitted with the base body without their loosening.

This invention also utilizes release lever 7 and locking lever 9 which are also fitted around said sleeves 15 and 16, respectively. Thus, said sleeves 15 and 16 support not only shafts 13 and 46, but also release lever 7 and locking lever 9.

In most part of prior art automobile key-less locking devices, the ratchet preventing the reversal of rotation of the latch has been used under tensile rather than compressive stress. In short, prior constructions where the reversal of rotation of the latch is prevented by engaging a ratchet pawl in a groove of a latch has the disadvantage of stress.

It is possible, however, with the construction of this invention that the base body be vertically mounted within a door, so that latch 10 is mounted in the upper portion of body 1, and ratchet 11 in its lower portion, and the ratchet 11 is thus engageable with latch 10 under compressive stress. By means of the above construction, this apparatus can be made at least as small as any conventional apparatus.

What we claim is:

1. Automobile locking apparatus comprising a one-piece, molded body made from synthetic resins, and having a recess in its front side, and a pair of spaced sleeves integral with and projecting from its back side coaxially of a pair of spaced, parallel axes, a pair of shafts secured in said sleeves coaxially thereof and projecting into said recess;

a cooperating latch and ratchet mounted in said recess each to pivot intermediate its ends about a different one of said shafts and into and out of operating positions in which said ratchet releasably secures said latch in latching engagement with the striker of an automobile door, a release lever pivotally mounted intermediate its ends on one of said sleeves and operatively connected to said ratchet selectively to impart pivotal movement thereto to effect release of said latch, and a locking lever pivoted on the other of said sleeves for movement into and out of a locking position in which it prevents said release lever from imparting said pivotal movement to said ratchet.

2. Automobile locking apparatus as defined in claim 1, wherein each of said release and locking levers, respectively, has formed thereon an integral sleeve which fits coaxially about one of said sleeves on said body pivotally to support the associated lever thereon.

3. Automobile locking apparatus comprising a latch rotatably mounted on a support for movement into latching engagement with the striker of an automobile body, a ratchet mounted adjacent said latch for movement into an operative position in which it releasably secures said latch in latching engagement with said striker, a locking lever mounted adjacent said ratchet and movable into a locking position in which it locks said ratchet in its operative position, a release lever operable by a door handle between door closed and door opening position, respectively, a link pivotally connected to said release lever and said locking lever, respectively, and pivotal in a first direction by said locking lever upon movement of the locking lever to its locking position, and a projection on said ratchet engagable with said link, when said release lever is in its door closed position, to prevent pivotal movement of said link in said first direction and said locking lever to its locking position.

4. A locking lever transfer device for automobile locking apparatus, comprising a latch rotatably mounted on a support for movement into latching engagement with the striker of an automobile body, a ratchet mounted adjacent said latch for movement into an operative position in which it releasably secures said latch in latching engagement with said striker, a locking lever mounted adjacent said ratchet and movable into a locking position in which it locks said ratchet in its operative position, a release lever operable by a door handle between door closed and door opening positions, respectively, a link connecting said release lever with said locking lever, said release lever being pivotal on said support and having thereon a sleeve disposed coaxially of its pivotal axis, a torsion coil spring mounted on said sleeve with one end thereof engaged with said release lever and the other end thereof with an abutment on said locking lever, said other end of said coil spring being engageable with two different surfaces on said abutment resiliently to hold said locking lever in its locking and unlocking positions, respectively.

* * * * *